United States Patent [19]

Youngclaus, Jr.

[11] 4,347,839

[45] Sep. 7, 1982

[54] GUM MASSAGE DEVICE

[75] Inventor: William P. Youngclaus, Jr., Elm Grove, Wis.

[73] Assignee: William R. Haljun, Kenilworth, Ill.

[21] Appl. No.: 178,846

[22] Filed: Aug. 18, 1980

[51] Int. Cl.[3] ..... A61H 7/00

[52] U.S. Cl. ..... 128/62 A

[58] Field of Search ..... 128/62 A, 62 R, 36, 128/65, 24.2, 35, 37

[56] References Cited

U.S. PATENT DOCUMENTS

| | | | |
|---|---|---|---|
| 1,825,353 | 9/1931 | Johnson | 128/62 A |
| 2,139,593 | 12/1938 | Koller et al. | 128/62 A |
| 3,563,233 | 2/1971 | Bodine | 128/62 A |
| 3,967,617 | 7/1976 | Krolik | 128/36 |
| 3,978,852 | 9/1976 | Annoni | 128/62 A |

*Primary Examiner*—Richard C. Pinkham
*Assistant Examiner*—T. Brown
*Attorney, Agent, or Firm*—Gary, Juettner & Pyle

[57] ABSTRACT

A gum massage device includes a soft tipped wand connected to a power unit. The power unit has a rotary shaft that is engaged in a socket in the base of the wand. The socket is angularly offset from the normal axis of the shaft and wand, and a member is connected between the wand and power unit to resiliently hold the shaft and wand in axial alignment. Rotation of the shaft caused the wand to oscillate in a desirable gum massaging motion.

5 Claims, 4 Drawing Figures

GUM MASSAGE DEVICE

BACKGROUND OF THE INVENTION

This invention relates broadly to a device for converting rotary motion to oscillating motion. More particularly, this invention relates to a gum massage device wherein the rotating shaft of a power unit is mechanically connected to a soft tipped wand in such a manner as to cause the wand to oscillate.

Gum massage devices are well known, and a variety of mechanisms for this purpose have been proposed. Massaging of the gums is an extremely important aspect of dental hygiene to stimulate circulation in the gums and maintain them in a strong and healthy state. Regular stimulation of the gums helps among other things to avoid the serious condition known as pyorrhea, which is an inflammation of the sockets of the teeth.

U.S. Pat. No. 3,967,617 and the numerous references cited therein provide a good history of the many types of vibrating or oscillating dental hygiene devices that heretofore have been proposed. In one type of device, the power unit itself contains the necessary mechanics to impart an oscillating motion to the wand. Another type of such device includes a vibrator element in the power unit, which produces a corresponding vibrating effect in the wand. While many of these devices perform the desired function of providing a gum massage, the mechanics thereof are usually very complex and hence expensive to produce, or are inefficient in producing the desired oscillatory motion in the soft tipped wand.

SUMMARY OF THE INVENTION

In the gum massage device of the present invention, a rotary shaft of a power unit is directly coupled to the soft tipped wand, and rotation of the shaft is mechanically converted into ocillatory motion at the tip of the wand. The mechanical conversion is effected by providing a socket in the base of the wand into which the shaft is inserted, the axis of said socket being angularly disposed with respect to the axis of the shaft and normal longitudinal axis of the wand. Means are also provided between the wand and the housing of the power unit for resiliently urging the wand into axial alighnment with the shaft, notwithstanding the tendency of the wand to be disposed at an angle. Under the aforesaid conditions, as the shaft rotates in the socket, an oscillatory or reciprocating motion is imparted to the wand, particularly at the soft tipped end thereof that is distal from the socket. Means may also be employed to adjust the intensity of the wand motion, said means being independent of the rotational speed of the shaft.

The gum massager of the present invention is advantageous over prior art devices due to the simplicity of construction and also because of the uncomplicated nature of the power unit required, i.e., a simple motor having an axial shaft. Other advantages will become apparent from the following description and appended claims.

THE DRAWING

DESCRIPTION OF THE PREFERRED EMBODIMENTS

Figure 1:
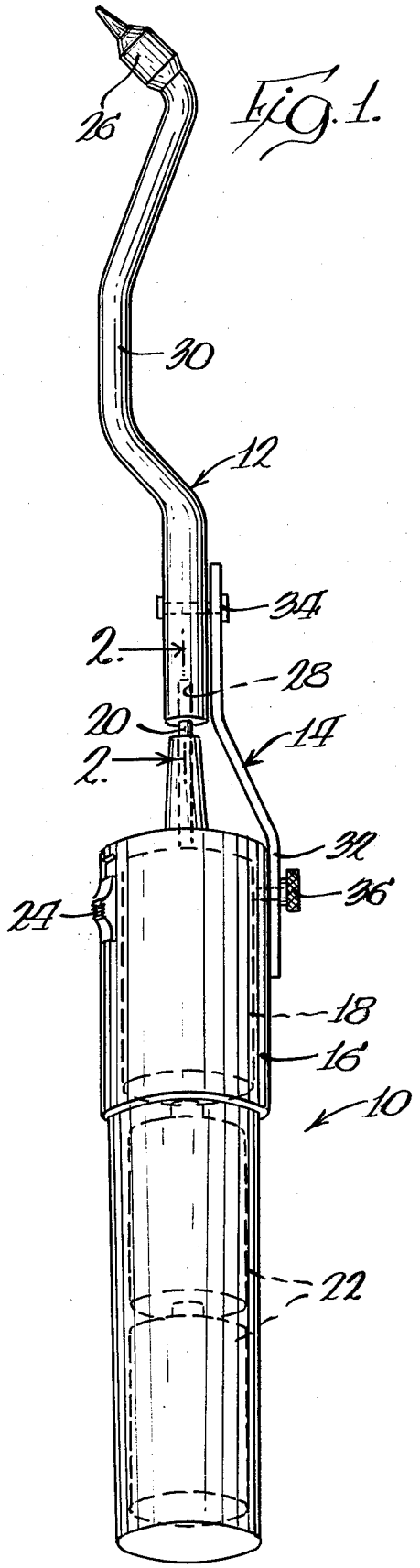
FIG. 1 is a side view of a gum massage device that incorporates features of the presently described invention.

As shown in FIG. 1, the device of the present invention generally comprises a power unit 10, a massage wand 12 connected to the power unit, and a resilient connection means 14 between the wand and the power unit.

The power unit 10 comprises a housing 16 containing a simply conventional motor 18 having an axial shaft 20 that rotates about its axis upon operation of the motor. The motor is preferably electric and is powered by one or more batteries 22 that may be located in the base of the housing 16. An on-off switch 24 for the motor is also preferably included at a convenient location on the shaft so as to enable selective operation of the motor when the power unit is held in the hand.

The series electrical connections between the batteries, switch and motor are conventional and will not be described herein in detail. Obviously, the motor can be operated from AC or DC source and may utilize DC batteries that are rechargeable from an AC source, all of which modes are conventional. Alternately, a mechanical motor, such as one utilizing a wind-up spring may be employed to rotate the shaft 20.

The wand 12 is an elongate member having a replaceable soft tip 26, which may be pointed or shaped as desired. The other end or base of the wand has a socket 28, which will be described in more detail. The central portion of the wand may be bent or curved such at 30 away from the axis of the wand at the base, which serves to amplify the motion imparted from the base to the tip.

As shown in FIG. 1, the base of the wand 12 and the shaft 20 of the power unit 10 are substantially in axial alignment and are maintained in alignment by a flexible strap 32 or other suitable means secured between the wand and the power unit. As shown, one end of the strap 32 may be secured to the wand by a pin or rivit 34, and the other end may be adjustably secured by an adjustable screw 36 to the housing 16, with the strap preferably following the contour of the connected parts. The strap 32, of course, also serves to retain the wand in operative engagement with the shaft and also prevents rotation of the wand.

Figure 2:
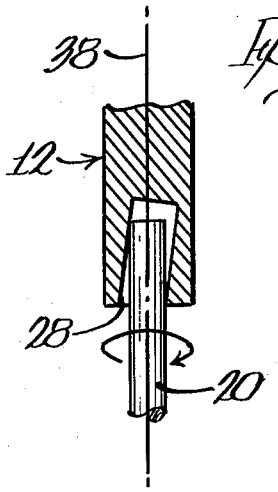
FIG. 2 is a sectional view taken along lines 2—2 of FIG. 1.

As shown in FIG. 2, the socket 28 in the base of the wand 12 is not in axial alignment with the normal longitudinal axis 38 of the shaft 20 and wand. Rather, the socket 28 is somewhat larger in diameter than the diameter of the shaft and is angularly disposed relative to the normal longitudinal axis 38 of the shaft and wand. Upon rotation of the shaft as shown in FIG. 2, together with the constraining influence of the strap 32, the wand is caused to generate a reciprocating oscillatory motion. It may be seen from FIG. 2 that no special shape is required on the shaft or the socket, and in fact, both may be cylindrical. Although not shown, either the shaft or the socket may be provided with an abrasion resistant or lubricating surface to minimize wear, since the desired motion is caused by rotation of the shaft in the misaligned socket, with only portions of the shaft being in contact with the socket, i.e., portions located near the entrance of the socket and at the end of the shaft. The resulting motion imparted to the wand is very rapid or vibratory-like and is ideally suitable for adaption to a gum massage device.

If desired, the intensity and characteristics on the wand 12 may be controlled by varying the speed of the motor, changing the dimensions of the socket and shaft, etc. Another and more expedient way of controlling the intensity or force of the motion is simply by changing the degree of resiliency of the strap 32. This may be done for example, by the adjustment screw 36 that connects strap 32 to the housing 16. The intensity is at maximum with the screw fully tightened and lessens as the screw is loosened, allowing the strap to move somewhat and absorb some of the vibration.

Figure 3:
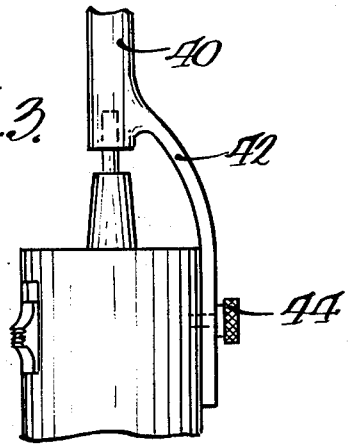
FIGS. 3 and 4 are fragmentary side views (FIG. 4 being partly in cross section) of other embodiments of the invention.
Figure 4:
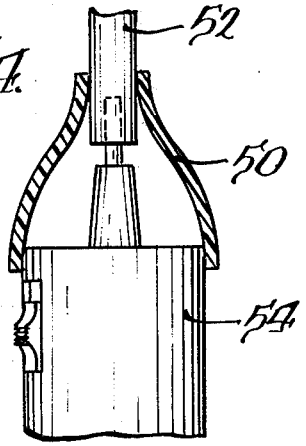

FIGS. 3 and 4 illustrate alternatives to connecting the wand to the housing other than the use of the strap 32 shown in FIG. 1. As shown in FIG. 3, the wand 40 may have an integrally formed arm 42 extending from near the base of the wand and terminating at one side of the housing to be secured thereto by an adjustable screw 44.

As shown in FIG. 4, the same result may be obtained with the use of a flexible sleeve 50 having its ends engaged over the base of the wand 52 and the end of the housing 54.

I claim:

1. A gum massage device comprising a wand having a massage element at one end and a socket in the other end, a shaft frictionally engaged in said socket, said socket being angularly disposed relative to the axis of said shaft with said wand being rockable on said shaft, means for rotating said shaft, and means for resiliently holding said wand in substantial axial alignment with said shaft and preventing rotation of said wand, whereupon an oscillatory motion is imparted to said wand upon rotation of said shaft.

2. The device of claim 1 wherein the means for holding said wand includes means for controlling the resiliency thereof.

3. The device of claim 1 wherein the means for rotating said shaft includes a housing, and the means for resiliently holding the wand is connected between the wand and the housing.

4. The device of claim 3 wherein the means for resiliently holding the wand is connected to the housing by an adjustable screw.

5. A gum massage device comprising a wand connected to a power unit, said wand having a gum massage element at one end and a socket in the other end, said power unit comprising a housing with a shaft extending from the housing, means for rotating said shaft about its axis, and means connected between the wand and housing for resiliently holding said wand and shaft in substantial longitudinal alignment and substantially preventing rotation of said wand, said socket having a diameter larger than the diameter of said shaft, said socket receiving said shaft and being angularly disposed relative to the axis thereof, with said shaft and socket being in limited frictional engagement, whereby rotation of said shaft produces oscillatory motion in said wand.

* * * * *